US009524692B2

(12) United States Patent
Zheng et al.

(10) Patent No.: US 9,524,692 B2
(45) Date of Patent: Dec. 20, 2016

(54) SIGNAL CORRECTING METHOD AND SIGNAL CORRECTING DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Yi Zheng, Beijing (CN); Shuai Xu, Beijing (CN); Zhiyong Wang, Beijing (CN); Zhengxin Zhang, Beijing (CN); Wensen Shi, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/548,928

(22) Filed: Nov. 20, 2014

(65) Prior Publication Data

US 2015/0317940 A1 Nov. 5, 2015

(30) Foreign Application Priority Data

May 4, 2014 (CN) ..... 2014 1 0184621

(51) Int. Cl.
*G09G 5/00* (2006.01)
*G09G 3/36* (2006.01)

(52) U.S. Cl.
CPC ..... *G09G 3/3696* (2013.01); *G09G 3/3648* (2013.01); *G09G 2310/06* (2013.01); *G09G 2310/08* (2013.01); *G09G 2330/06* (2013.01)

(58) Field of Classification Search
USPC ..... 345/208, 92, 211, 204, 76, 82, 87, 94
See application file for complete search history.

(56) References Cited

U.S. PATENT DOCUMENTS 7,863,876 B2 1/2011 Cook et al.
2003/0063053 A1* 4/2003 Yamazaki ..... G09G 3/3241 345/82

(Continued)

FOREIGN PATENT DOCUMENTS

CN 1640011 A 7/2005
CN 1940647 A 4/2007

(Continued)

OTHER PUBLICATIONS

Chinese Office Action dated Oct. 10, 2015 issued in corresponding Chinese Application No. 201410184621.X.

*Primary Examiner* — Thuy Pardo
(74) *Attorney, Agent, or Firm* — Nath, Goldberg & Meyer; Joshua B. Goldberg; Leonid D. Thenor

(57) ABSTRACT

A signal correcting method and a signal correcting device. The signal correcting method includes sampling a signal to be corrected at different sampling times, and comparing a signal value at each of the sampling times in one signal period with a preset signal value corresponding to the sampling time. When the signal value at the sampling time is equal to the corresponding preset signal value, the signal value at the sampling time is kept unchanged. When the signal value at the sampling time is not equal to the corresponding preset signal value, the signal value at the sampling time is corrected to be the preset signal value corresponding to the sampling time.

12 Claims, 3 Drawing Sheets

(56) References Cited

U.S. PATENT DOCUMENTS

| | | | | |
|---|---|---|---|---|
| 2004/0135778 | A1* | 7/2004 | Sato | G09G 3/3688 345/204 |
| 2005/0099374 | A1* | 5/2005 | Sagawa | G09G 3/3648 345/87 |
| 2007/0097038 | A1* | 5/2007 | Yamazaki | G09G 3/3241 345/76 |
| 2007/0152920 | A1* | 7/2007 | Yamashita | G09G 3/3233 345/76 |
| 2009/0079684 | A1* | 3/2009 | Watanabe | G09G 3/3655 345/92 |
| 2009/0315871 | A1* | 12/2009 | Kobayashi | G09G 5/006 345/208 |
| 2010/0214276 | A1* | 8/2010 | Tanikame | G09G 3/3233 345/211 |
| 2013/0135280 | A1* | 5/2013 | Iida | G09G 3/3233 345/211 |

FOREIGN PATENT DOCUMENTS

| | | | |
|---|---|---|---|
| CN | 102064927 | A | 5/2011 |
| CN | 103092256 | A | 5/2013 |
| CN | 103546153 | A | 1/2014 |
| JP | H10190456 | A | 7/1998 |

* cited by examiner

SIGNAL CORRECTING METHOD AND SIGNAL CORRECTING DEVICE

FIELD OF THE INVENTION

The present invention relates, to the field of correction of interfered signals, and particularly to a signal correcting method and a signal correcting device.

BACKGROUND OF THE INVENTION

With the development of liquid crystal display technology, the integration level of a drive circuit is getting higher and higher, and the volume of an integrated circuit is getting smaller and smaller, which results in degraded anti-static capability of the integrated circuit, for example, in the application of liquid crystal display technology in industrial control area, all signals are subjected to various inferences. As shown in FIG. 1, when gate control signals (including a clock pulse signal (CPV) and an output enable signal (OE)) are interfered, timing skew may occur. Since only when the clock pulse signal and the output enable signal are both at a high level, a gate can be controlled to output, the gate of a thin film transistor cannot be turned, on normally if a timing skew occurs between the clock pulse signal and the output enable signal, thus affecting normal display is of a display device (e.g., defect of ripple occurs).

Therefore, how to avoid timing skew between the clock pulse signal and the output enable signal has become an urgent technical problem to be solved in this filed.

SUMMARY OF THE INVENTION

An object of the present invention is to provide a signal correcting method and a signal correcting device, so as to correct interfered signals.

In order to achieve the above object, the present invention provides a signal correcting method comprising steps of:

S10, sampling a signal to be corrected at different sampling times;

S20, comparing a signal value at each of the sampling times in one signal period with a preset signal value corresponding to the sampling time, when the signal value at the sampling time is equal to the corresponding preset signal value, keeping the signal value at the sampling time unchanged; and when the signal value at the sampling time is not equal to the corresponding preset signal value, proceeding to step S30; and S30, correcting the signal value at the sampling time to be the preset signal value corresponding to the sampling time.

Preferably, the signal correcting method, before step S20, further comprises a step of:

S15, storing a plurality of preset signal values corresponding to respective sampling times, respectively.

Preferably, step S20 starts to be performed in the second period of the signal to be corrected, and the preset signal values are signal values corresponding to the sampling times in the first period of the signal to be corrected.

Preferably, the signal correcting method, after step S30, further comprises a step of:

S40, filling signal values between adjacent sampling times so that an adjusted signal waveform in each period is the same as a signal waveform in the first period.

Preferably, a sampling frequency in step S10 is five to ten times as large as a frequency of the signal to be corrected.

Correspondingly, the present invention also provides a signal correcting device comprising:

a sampling module, configured to sample a signal to be corrected at different sampling times and output a signal value of the signal to be corrected at each of the sampling times to a detecting module;

the detecting module, configured to receive the signal value of the signal to be corrected at each of the sampling times output from the sampling module, compare a signal value at each of the sampling times in one signal period with a preset signal value corresponding to the sampling time to determine whether interference occurs or not at each of the sampling times, and output a signal indicating whether interference occurs or not at the sampling time to a correcting module;

the correcting module, configured to receive the signal indicating whether interference occurs or not at the sampling time from the detecting module, and correct a signal value at the sampling time at which interference occurs to be a preset signal value corresponding to the sampling time.

Preferably, the detecting module comprises a voltage comparator configured to compare the signal value at each of the sampling times with the corresponding preset signal value, and output the signal indicating whether interference occurs or not at the sampling time.

Preferably, the signal correcting device further comprises a storage module configured to store a plurality of preset signal values corresponding to the sampling times, respectively.

Preferably, the plurality of preset signal values are signal values corresponding to the sampling times in the first period of the signal to be corrected, respectively.

Preferably, the signal indicating whether interference occurs or not at the sampling time includes a high-level signal and a low-level signal, when the signal value at the sampling time is equal to the corresponding preset signal value, the voltage comparator outputs the low-level signal, and when the signal value at the sampling time is not equal to the corresponding preset signal value, the voltage comparator outputs the high-level signal;

the correcting module comprises a first triode and a second triode, both bases of the first and second triodes are connected to an output terminal of the voltage comparator, a collector of the first triode is connected to an input terminal of the signal correcting device, an emitter of the first triode is connected to an output terminal of the signal correcting; device, a collector of the second triode is connected to an output terminal of the storage module, and an emitter of the second triode is connected to the output terminal of the signal correcting device; when the voltage comparator outputs the low-level signal, the first triode is turned on, and when the voltage comparator outputs the high-level signal, the second triode is turned on.

Preferably, the signal correcting device further comprises a filling module configured to fill signal values between adjacent sampling times so that an adjusted signal waveform in each period is the same as a signal waveform in the first period.

Preferably, the filling module comprises a third triode and a fourth triode, a base of the third triode is connected to the emitter of the second triode, a collector of the third triode is connected to the storage module, and an emitter of the third triode is connected to the output terminal of the signal correcting device; a base of the fourth triode is connected to the emitter of the second triode, a collector of the fourth triode is connected to the storage module, and an emitter of the fourth triode is connected to the output terminal of the signal correcting device; when the second triode is turned on and the collector of the second triode is applied with a high level, the third triode is turned on, and when the second triode is turned on and the collector of the second triode is applied with a low level, the fourth triode is turned on.

It can be seen that the present invention can detect whether interference occurs at sampling times and correct the signal value at the sampling time at which interference occurs to be the corresponding preset signal value. As a result, a timing skew of the signal waveform is reduced on the whole, influence of external interference on the signal to be corrected is diminished, and further resistance of a driving module using the signal to interference is improved.

BRIEF DESCRIPTION OF THE DRAWINGS

The accompanying drawings, as a part of the specification, is used for providing a further understanding of the present invention, and explaining the present invention in conjunction with the following specific implementations, rather than limiting the present invention. In the accompanying drawings.

DETAILED DESCRIPTION OF THE EMBODIMENTS

Specific implementations of the present invention will be described in detail below in conjunction with the accompanying drawings. It should be understood that, the specific implementations described herein are merely used for illustrating and explaining the present invention, rather than limiting the present invention.

Figure 1:
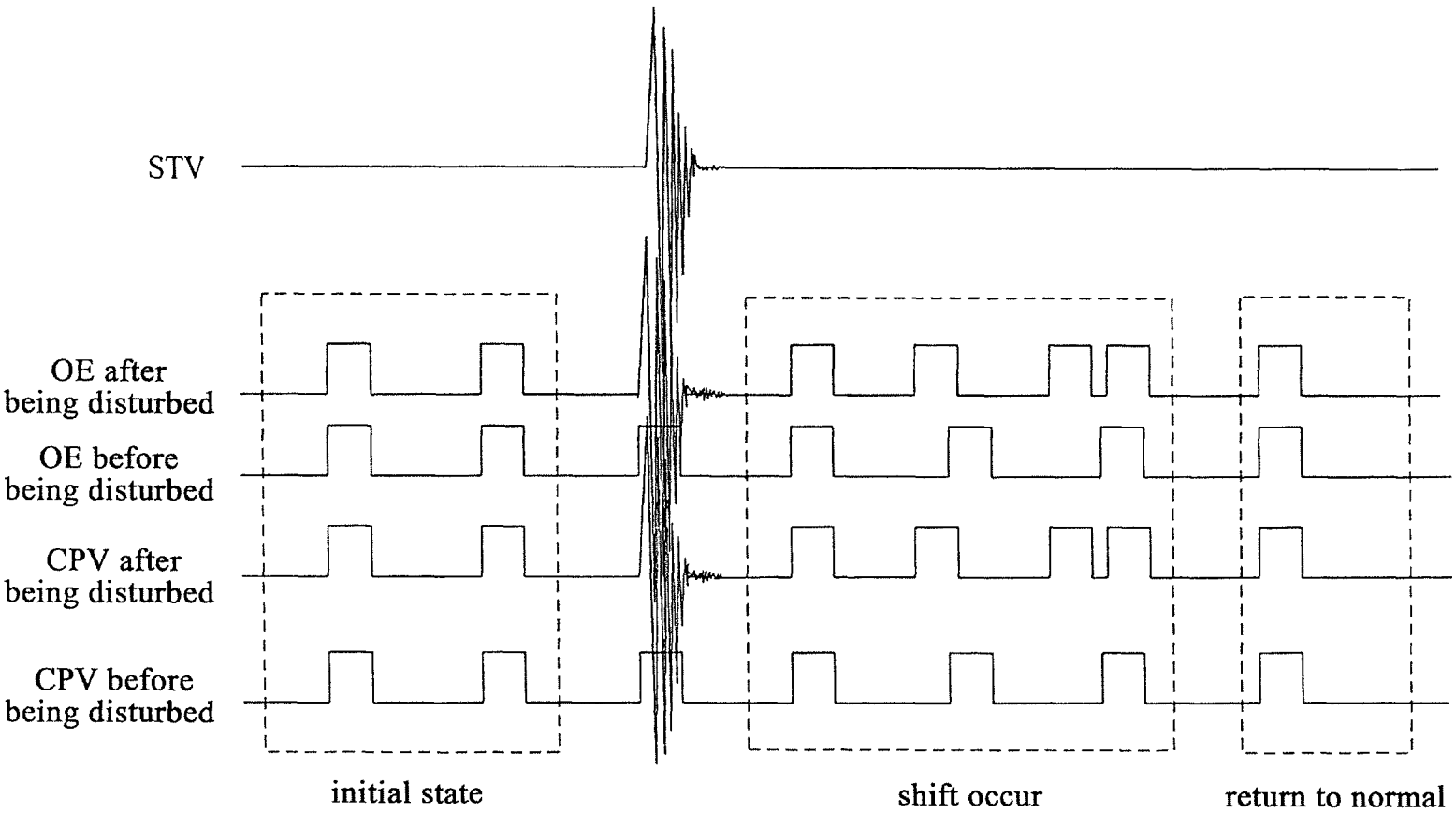
Fig. 1 (Prior Art)
FIG. 1 is a schematic diagram of waveforms in a case that a timing skew occurs as CPV signals and OE signals are interfered.
Figure 2:
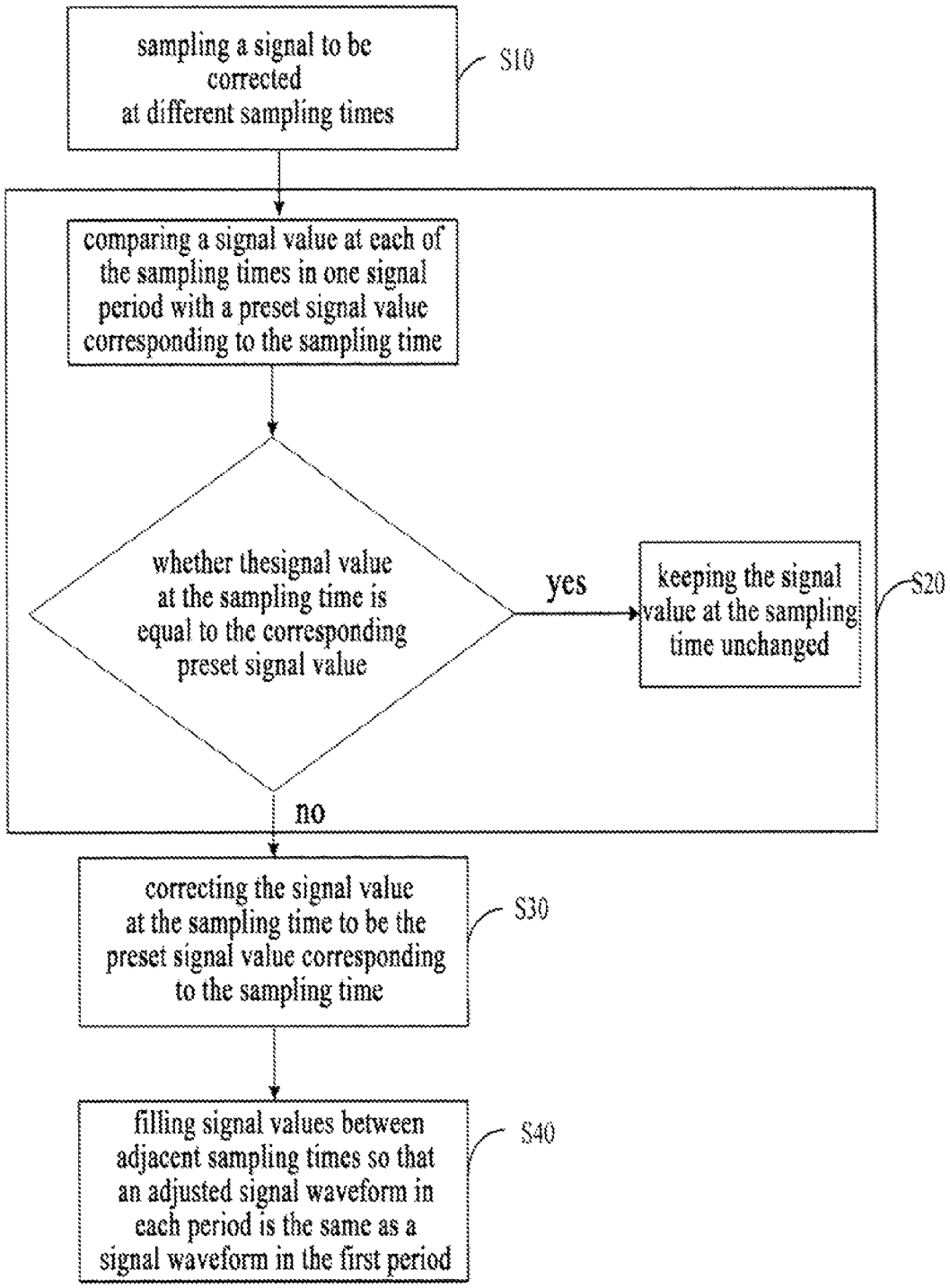
FIG. 2 is a schematic diagram illustrating steps included in a signal correcting method provided by the present invention.

As an aspect of the present invention, there is provided a signal correcting method, as shown in FIG. 2, the signal correcting method comprises the following steps of:

S10, sampling a signal to be corrected at different sampling times, wherein, the number of samples is not limited, and may be set as required;

S20, comparing a signal value at each of the sampling times in one signal period with a preset signal value corresponding to the sampling time when the signal value at the sampling time is equal to the corresponding preset signal value, keeping the signal value at the sampling time unchanged; and when the signal value at the sampling time is not equal to the corresponding preset signal value, proceeding to step S30; and S30, correcting the signal value at the sampling time to be the preset signal value corresponding to the sampling time.

Figure 3:
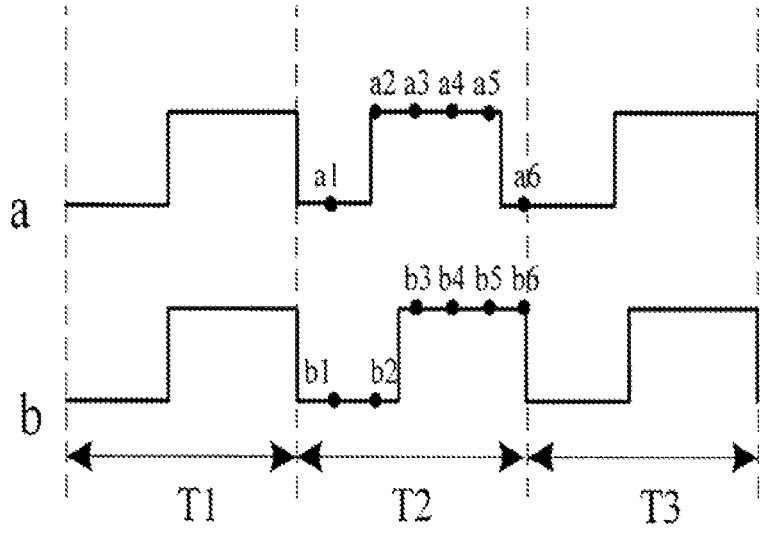
FIG. 3 is a schematic diagram illustrating correspondence between a plurality of sampling times of a signal and a plurality of preset signal values corresponding to the plurality of sampling times.

The one signal period described above is one period of the signal to be corrected, as shown in FIG. 3, a waveform of a signal a is a waveform of a signal which suffers a timing skew after being disturbed, and a waveform of a signal b is a normal signal waveform. Taking a period T2 as an example, a1, a2, a3, a4, a4, a5 and a6 are sampling times for the disturbed signal a (i.e., signal to be corrected) in the period T2, and signal values at times b1, b2, b3, b4, b5 and b6 are preset signal values corresponding to the sampling times a1, a2, a3, a4, a4, a5 and a6 in the signal a, respectively in the normal signal b (i.e., standard signal without being disturbed). A signal value at each of the sampling times is compared with a corresponding preset signal value. When the signal value at a sampling time is equal to the corresponding preset signal value (for example, in FIG. 3, the signal values at sampling times a1, a3, a4 and a5 are equal to those at times b1, b3, b4 and b5, respectively), it is determined that no interference occurs at the sampling time (a1, a3, a4 and a5) and the signal value at the sampling time (a1, a3, a4 and a5) remains unchanged; when the signal value at the sampling time is not equal to the corresponding preset signal value (for example, in FIG. 3, the signal values at sampling times a2 and a6 are not equal to those at times b2 and b6, respectively), it is determined that interference occurs to the signal at the sampling time (sampling times a2 and a6) and the signal value at the sampling time (sampling times a2 and a6) is corrected to be the corresponding preset signal value (i.e. signal values at times b2 and b6, respectively).

By correcting the signal value at a sampling time at which interference occurs, the signal value at the sampling time at which interference occurs is equal to the corresponding preset signal value, occurrence of timing skew of the signal waveform is reduced on the whole, influence of external interference on the signal to be corrected is diminished, and further resistance of a driving module using the signal to interference is improved.

To facilitate a comparison between the signal values at sampling times and the corresponding preset signal values, before, step S20, the signal correcting method may further comprise a step of:

S15, storing a plurality of preset signal values corresponding to the sampling times respectively.

In the present invention, the preset signal values may be set in various ways, for example, when the signal to be corrected is a gate control signal of an array substrate of a display device, the preset signal value corresponding to each sampling time may be recorded through experimentation under the condition that a gate of a thin film transistor is turned on normally.

In the present invention, when to perform step S15 is not particularly limited. For example, step S15 may be performed between steps S10 and S20. Alternatively, step S15 may be performed before step S10.

As a specific implementation of the present invention, step S20 starts to be performed in the second period of the signal to be corrected, and the preset signal values are set to be signal values corresponding to the sampling times in the first period of the signal to be corrected. That is, signal values at the sampling times in the n-th (n is an integer larger than 1) period of the signal to be corrected are compared with signal values at corresponding sampling times in the first period. Specifically, taking the second period of the signal to be corrected as an example, a signal value at the first sampling time in the second period of the signal to be corrected is compared with a signal value at the first sampling time in the first period, a signal value at the second sampling time in the second period of the signal to be corrected is compared with a signal value at the second sampling time in the first period, and the rest can be done in the same manner until comparisons between signal values at all of the sampling times in the second period and those at corresponding sampling times in the first period are completed. Similarly the above comparison process applies to the rest of periods, that is, signal values at all of the sampling times in each of the remaining periods are compared with those at corresponding sampling times in the first period, respectively. Generally speaking, the first period of the signal is unlikely to be affected by external interference, and the timing sequence thereof is substantially accurate. Therefore, when signal values at respective sampling times in each of the remaining periods are corrected by using signal values at respective sampling times in the first period, the signal values at respective sampling times in each of the remaining periods are equal to those at respective sampling times in the first period correspondingly, which results in that signal waveform in each of the remaining periods is the same as that in the first period, and timing sequence of each of the remaining periods becomes the same as that of the first period (i.e. correct state).

In order to correct signal values between adjacent sampling times, further, as shown in FIG. 2, after step S30, the signal correcting method may further comprise a step of:

S40, filling signal values between adjacent sampling times so that an adjusted signal waveform in each period, is the same as a signal waveform in the first period. Filling manner is not limited in the present invention, as long as the adjusted signal waveform in each period is the same as the signal waveform in the first period. For example, taking a usual square signal as an example, when corrected signal values at two adjacent sampling times are equal to each other, a signal value between the two sampling times is determined to be the same value as the signal values at the two sampling times; when corrected signal values at two adjacent sampling times are not equal, the signal values at the two sampling times and between the two sampling times increase or decrease at a given rate.

It can be understood that, to facilitate correction of signal, sampling times used for comparison may be reduced. Specifically, when the signal value at a sampling time in a certain period is not equal to the corresponding preset signal value, the signal values at this sampling time and all sampling times after this sampling time in the same period may be directly corrected to be preset signal values corresponding to this sampling time and the sampling times alter this sampling time. As shown in FIG. 3, when it is determined that the signal value at sampling time a2 is not equal to that at the corresponding time b2 through comparison, the signal value at sampling time a2 is corrected to be the value at time b2, and signal values at all of the sampling times after sampling time a2 in the period 12 are corrected to be corresponding signal values after time b2; in the meanwhile, signal values at all sampling times in each of the periods after the period T2 are corrected to be corresponding preset signal values in the first period, so that the corrected signal waveform in each period is the same as the signal waveform in the first period.

In order to correct signals accurately and improve efficiency of correction, preferably, a sampling frequency in the step S10 may be five to ten times as large as a frequency of the signal to be corrected, that is, sampling is uniformly performed at five to ten sampling times per signal period.

The signal correcting method provided by the present invention has been described above, it can be seen that, with the signal correcting, method, signal value at a sampling time at which inference occurs is corrected, so that the signal value at the sampling time at which inference occur is equal to the corresponding preset signal value, and as a result, occurrence of timing skew of the signal waveform is reduced, influence of external interference on the signal to be corrected is diminished, and resistance of a product to interference is improved.

Figure 4:
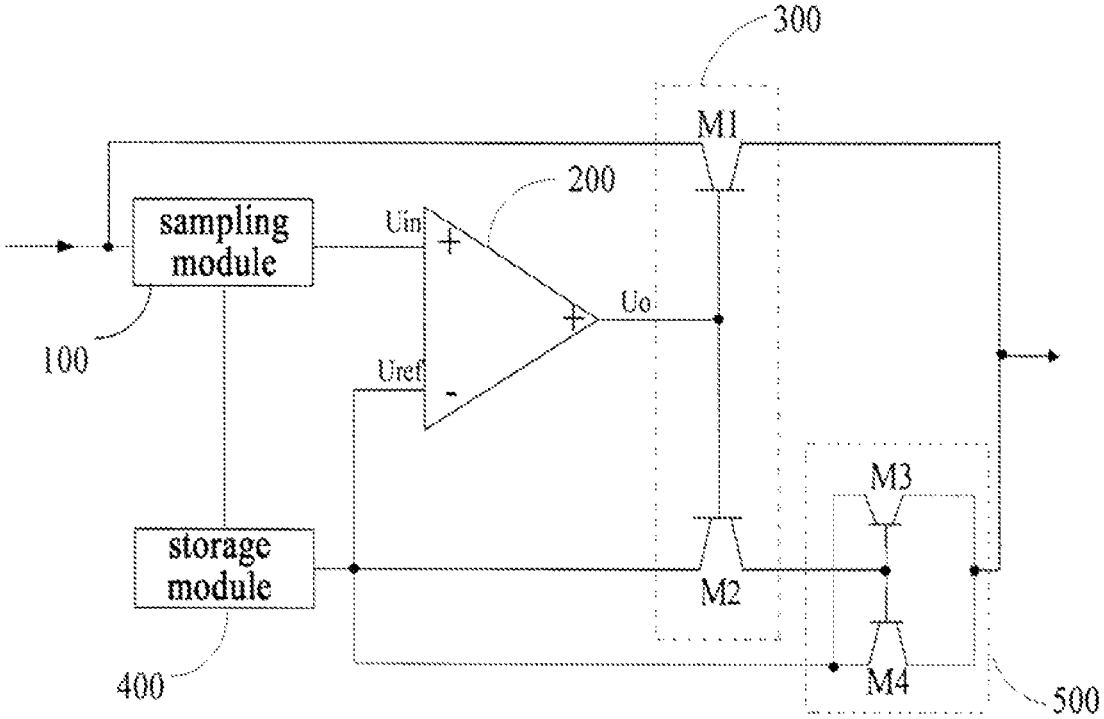
FIG. 4 is a schematic diagram of a structure of a signal correcting device provided by the present invention.

As another aspect of the present invention, there is provided a signal correcting device, as shown in FIG. 4, the signal correcting; device may comprise a sampling module 100, a detecting module 200 and a correcting module 300. The sampling module is configured to sample a signal to be corrected at different sampling times, and output a signal value of the signal to be corrected at each of the sampling times to the detecting module 200; the detecting module 200 is configured to receive the signal value of the signal to be corrected at each sampling time output from the sampling module, compare a signal value at each of the sampling times in one signal period of the signal to be corrected with a preset signal value corresponding to the sampling time to determine whether interference occurs or not at each of the sampling times, and output a signal indicating whether interference occurs or not at the sampling time to the correcting module 300; the correcting module 300 is configured to receive the signal indicating whether interference occurs or not at the sampling time output from the detecting module 200, correct a signal value at a sampling time at which interference occurs to be a preset signal value corresponding to the sampling time.

Further, as shown in FIG. 4, the detecting module 200 may comprise a voltage comparator configured to compare the signal value at each of the sampling times with the corresponding present signal value, so as to determine whether interference occurs or not at each of the sampling times, so that corresponding processes may be performed on signal values at sampling times at which interference occurs and signal values at sampling times at which no interference occurs, separately. In FIG. 4, $U_{in}$ and $U_{ref}$ are two input terminals of the voltage comparator, $U_o$ is an output terminal of the voltage comparator, the terminal $U_{in}$ is connected to an output terminal of the sampling module 100, and a signal value at each of the sampling times is input from the terminal $U_{in}$, a preset signal value corresponding to each of the sampling times is input from the terminal $U_{ref}$, and the terminal $U_o$ is connected to the correcting module 300 and outputs a signal indicating whether interference occurs or not at the sampling time.

It should be noted that, the voltage comparator may calculate an absolute value of a difference between two input voltages. It can be easily understood that, the absolute value of the difference between two input voltages is a numerical value no less than zero. The voltage comparator outputs the signal indicating whether interference occurs or not at the sampling time based on the absolute value of the difference between two input voltages. When the two input voltages of the voltage comparator are equal to each other the absolute value of the difference between the two input voltages is zero), the voltage comparator outputs a low level (indicating that the signal at the sampling time is not disturbed); when the two input voltages of the voltage comparator are not equal (the absolute value of the difference between the two input voltages is larger than zero), the voltage comparator outputs a high level (indicating that the signal at the sampling time is disturbed).

Further, as shown in FIG. 4, the signal correcting device may also comprises a storage module 400 configured to store a plurality of preset signal values corresponding to the sampling times respectively.

To facilitate setting of the preset signal values, further, the preset signal values may be signal values at the sampling times in the first period of the signal to be corrected. In this case, the storage module 400 is connected with the sampling module 100, and the sampling module 100 transfers the signal values at the respective sampling times in the first period of the signal to be corrected to the storage module 400 to be stored.

As described above, the signal indicating whether interference occurs or not at the sampling time includes a high-level signal and a low-level signal. In order to facilitate performing corresponding processes on signal values at sampling times at which interference occurs and signal values at sampling times at which no interference occur separately, further, as shown in FIG. 4, the correcting module 300 may comprise a first mode M1 and a second triode M2, both bases of the first triode M1 and the second triode M2 are connected to the output terminal of the voltage comparator, a collector of the first triode M1 is connected to an input terminal of the signal correcting device, an emitter of the first triode M1 is connected to an output terminal of the signal correcting device, a collector of the second triode M2 is connected to an output terminal of the storage module 400, and an emitter of the second triode M2 is connected to the output terminal of the signal correcting device; when the output of the voltage comparator is zero (i.e., low level), the first triode M1 is turned on, and when the output of the voltage comparator is not zero (i.e., high level), the second triode M2 is turned on. For example, the first triode M1 may be a P-type triode, the second triode M2 may be a N-type triode, when the output of the voltage comparator is at a low level, that is, when the signal value at the sampling time is equal to the corresponding preset signal value, the P-type triode (i.e., the first triode M1) is turned on, an input signal is directly output from the output terminal of the signal correcting device; when the output of the voltage comparator is at a high level, that is, when the signal value at the sampling time is not equal to the corresponding preset signal value, the N-type triode (i.e., the second triode M2) is turned on, the signal value stored in the storage module 400 is output as the corrected signal value at the corresponding sampling time.

Further, as shown in FIG. 4, the signal correcting device may also comprise a filling module 500, which is connected between the second triode M2 and the output terminal of the signal correcting device, and configured to fill signal values between adjacent sampling times so that a adjusted signal waveform in each period is the same as a signal waveform in the first period.

As a specific implementation of the present invention, as shown in FIG. 4, the filling module 500 may comprise a third triode M3 and a fourth triode M4, a base of the third triode M3 is connected to the emitter of the second triode M2, a collector of the third triode M3 is connected to the storage module 400, and an emitter of the third triode M3 is connected to the output terminal of the signal correcting device; a base of the fourth triode M4 is connected to the emitter of the second triode M2, a collector of the fourth triode M4 is connected to the storage module 400, and an emitter of the fourth triode M4 is connected to the output terminal of the signal correcting device; when the second triode M2 is turned on and the collector of the second triode M2 is applied with a high level, the third triode M3 is turned on, and when the second triode M2 is turned on and the collector of the second triode M2 is applied with a low level, the fourth triode M4 is turned on.

For example, the third triode M3 may be a N-type triode, and the fourth triode M4 may be a P-type triode. When the output of the voltage comparator is not zero (i.e., high level), the second triode M2 is turned on. At this point, when the collector of the second triode M2 is applied with a high level, the third triode M3 is turned on, and the high level is output as the corrected value; when the collector of the second triode M2 is applied with a low level, the fourth triode M4 is turned on, and the low level is output as the corrected value.

It can be understood that above implementations are merely exemplary implementations used for explaining the principle of the present invention, but the present invention is not limited thereto. For those skilled in the art, various modifications and improvements may be made without departing from the spirit and essence of the present invention, and these modifications and improvements are deemed as filling within the protection range of the present invention.

The invention claimed is:

1. A signal correcting method, comprising steps of:

sampling a signal to be corrected at different sampling times using a sampling module;

storing values corresponding to the sampling times of a first period of the signal as a plurality of preset signal values;

comparing, using a detecting module, a signal value at each of the sampling times in one signal period with a preset signal value corresponding to the sampling time, and when the signal value at the sampling time is equal to the corresponding preset signal value, keeping the signal value at the sampling time unchanged; and correcting, using a signal correcting device, the signal value at the sampling time to be the preset signal value corresponding to the sampling time, when the signal value at the sampling time is not equal to the corresponding preset signal value, wherein the step of comparing starts to be performed in the second period of the signal to be corrected.

2. The signal correcting method according to claim 1, wherein, the signal correcting method, after the step of comparing, further comprises a step of:

filling signal values between adjacent sampling times so that an adjusted signal waveform in each period is the same as a signal waveform in the first period.

3. The signal correcting method according to claim 2, wherein, a sampling frequency in the step of sampling is five to ten times as large as a frequency of the signal to be corrected.

4. The signal correcting method according to claim 1, wherein, a sampling frequency in the step of sampling is five to ten times as large as a frequency of the signal to be corrected.

5. The signal correcting method according to claim 1, wherein the step of correcting further comprises automatically correcting the signal value of all subsequent sampling times in the same period to the corresponding preset value, when the signal value at the sampling time is not equal to the corresponding preset signal value.

6. A signal correcting device, comprising:

a sampling module, configured to sample a signal to be corrected at different sampling times, and output a signal value of the signal to be corrected at each of the sampling times to a detecting module;

a storage module, configured to store values corresponding to the sampling times of a first period of the signal as a plurality of preset signal values;

the detecting module, configured to receive the signal value of the signal to be corrected at each of the sampling times output from the sampling module, compare a signal value at each of the sampling times in one signal period with a preset signal value corresponding to the sampling time to determine whether interference occurs or not at each of the sampling times, and output a signal indicating whether interference occurs or not at the sampling time to a correcting module; and the correcting module, configured to receive the signal indicating whether interference occurs or not at the sampling time output from the detecting module, and correct a signal value at the sampling time at which interference occurs to be a preset signal value corresponding to the sampling time, wherein the detecting module begins comparing signal values in the second period of the signal to be corrected.

7. The signal correcting device according to claim 6, wherein, the detecting module comprises a voltage comparator configured to compare the signal value at each of the sampling times with the corresponding preset signal value, and output the signal indicating whether interference occurs at the sampling time.

8. The signal correcting device according to claim 7, wherein, the signal indicating whether interference occurs or not at the sampling time includes a high-level signal and a low-level signal, when the signal value at the sampling time is equal to the corresponding preset signal value, the voltage comparator outputs the low-level signal, and when the signal value at the sampling time is not equal to the corresponding preset signal value, the voltage comparator outputs the high-level signal; and the correcting module comprises a first triode and a second triode, both bases of the first and second triodes are connected to an output terminal of the voltage comparator, a collector of the first triode is connected to an input terminal of the signal correcting device, an emitter of the first triode is connected to an output terminal of the signal correcting device, a collector of the second triode is connected to an output terminal of the storage module, and an emitter of the second triode is connected to the output terminal of the signal correcting device; when the voltage comparator outputs the low-level signal, the first triode is turned on, and when the voltage comparator outputs the high-level signal, the second triode is turned on.

9. The signal correcting device according to claim 8, wherein, the signal correcting device further comprises a filling module configured to fill signal values between adjacent sampling times so that an adjusted signal waveform in each period is the same as a signal waveform in the first period.

10. The signal correcting device according to claim 9, wherein, the filling module comprises a third triode and a fourth triode, a base of the third triode is connected to the emitter of the second triode, a collector of the third triode is connected to the storage module, and an emitter of the third triode is connected to the output terminal of the signal correcting device; a base of the fourth triode is connected to the emitter of the second triode, a collector of the fourth triode is connected to the storage module, and an emitter of the fourth triode is connected to the output terminal of the signal correcting device; when the second triode is turned on and the collector of the second triode is applied with a high level, the third triode is turned on, and when the second triode is turned on and the collector of the second triode is applied with a low level, the fourth triode is turned on.

11. The signal correcting device according to claim 6, wherein, the signal correcting device further comprises a filling module configured to fill signal values between adjacent sampling times so that an adjusted signal waveform in each period is the same as a signal waveform in the first period.

12. The signal correcting device according to claim 6, wherein the signal correcting device is further configured to automatically correct the signal value of all subsequent sampling times in the same period to the corresponding preset value, when the signal value at the sampling time is not equal to the corresponding preset signal value.

* * * * *